US005904198A

United States Patent [19]

Huang

[11] Patent Number: 5,904,198

[45] Date of Patent: May 18, 1999

[54] OPERATING DEVICE FOR A VENETIAN BLIND TO CONTROL RAISING AND LOWERING OF THE SLATS AND TO ADJUST TILTING ANGLE OF THE SLATS

[76] Inventor: Tai-Long Huang, No. 382, Sec. 1, Yuan-Lu Rd., Fu-Hsing, Hsiang, Chang Hua Hsien, Taiwan

[21] Appl. No.: 08/972,514

[22] Filed: Nov. 18, 1997

Related U.S. Application Data

[63] Continuation-in-part of application No. 08/844,406, Apr. 18, 1997, Pat. No. 5,749,405.

[51] Int. Cl.[6] ..... E06B 9/30

[52] U.S. Cl. ..... 160/168.1 R; 160/176.1 R; 160/178.2 R

[58] Field of Search ..... 160/107, 168.1 R, 160/170 R, 171 R, 172 R, 173 R, 176.1 R, 177 R, 178.1 R, 178.2 R

[56] References Cited

U.S. PATENT DOCUMENTS

| | | | |
|---|---|---|---|
| 3,952,789 | 4/1976 | Marotto | 160/168.1 R |
| 4,352,386 | 10/1982 | Butler et al. | 160/178.2 R |
| 5,465,775 | 11/1995 | Biba et al. | 160/168.1 R |
| 5,472,035 | 12/1995 | Biba et al. | 160/168.1 R |
| 5,472,036 | 12/1995 | Judkins | 160/178.2 R |
| 5,553,649 | 9/1996 | Chisaka et al. | 160/168.1 R |
| 5,553,653 | 9/1996 | Rozon | 160/173 R |
| 5,671,793 | 9/1997 | Lee | 160/168.1 R |
| 5,709,258 | 1/1998 | Coccoluto | 160/168.1 R |
| 5,749,405 | 5/1998 | Huang | 160/168.1 R |

*Primary Examiner*—Daniel P. Stodola
*Assistant Examiner*—Bruce A. Lev
*Attorney, Agent, or Firm*—Ladas & Parry

[57] ABSTRACT

A mechanism for combining, into a single structure, the functions of raising, lowering and tilting the slats of a Venetian blind. The mechanism is attached to a slat actuating shaft and comprises a hollow positioning tube coupled to the shaft so that axial rotation of tube rotates the shaft and tilts the slats to a desired angle. Slat pull ropes extend into the hollow portion of the tube. The hollow portion of the tube also contains a releasable clamping unit and a stationary roller which is rotatably coupled to the tube. The releasable clamping unit comprises a movable roller and a biasing spring which forces the movable roller toward the stationary roller so that the pull ropes are clamped between the rollers when the slats are raised or lowered to a desired position. An elongated sleeve is mounted on and slidable with respect to the tube. The sleeve is coupled to the releasable clamping unit so that when the sleeve is moved downward along the tube, the movable roller moves away from the stationary roller to release the pull ropes.

5 Claims, 7 Drawing Sheets

OPERATING DEVICE FOR A VENETIAN BLIND TO CONTROL RAISING AND LOWERING OF THE SLATS AND TO ADJUST TILTING ANGLE OF THE SLATS

CROSS REFERENCE TO RELATED APPLICATION

This application is a continuation-in-part (CIP) of U.S. patent application Ser. No. 08/844,406, filed on Apr. 18, 1997, now U.S. Pat. No. 5,749,405.

BACKGROUND OF THE INVENTION

1. Field of the Invention

The present invention relates to an operating device for a Venetian blind to control raising and lowering of the slats and to adjust tilting angle of the slats, more particularly to an operating device which is capable of clamping releasably the pull ropes in an effective manner and which combines the functions of controlling raising and lowering of the slats and adjusting tilting angle of the slats in a single structure.

2. Description of the Related Art

Referring to FIG. 1, a conventional Venetian blind includes an elongated housing 1, a horizontally disposed shaft 2 journalled in the housing 1, a plurality of slats 5 suspended one above another from the housing 1, a bottom rail 7 disposed below the slats 5, a plurality of pull ropes 6, each of which has a first end that passes through the housing 1 and through the slats 5 and that is mounted to the bottom rail 7, and a second end that extends out of the housing 1, a clamping unit 8 provided at one end of the housing 1 for clamping releasably the pull ropes 6, a plurality of pairs of tilting cords 4 disposed at longitudinal sides of each of the slats 5 and having top ends secured to the shaft 2 and bottom ends secured to the bottom rail 7, a plurality of suspending strings 4*a* disposed below each of the slats 5 to interconnect the tilting cords 4, and a tilt control unit 9 coupled to the shaft 2 for controlling tilting of the slats 5.

Referring to FIG. 2, the clamping unit 8 is shown to include a hollow seat 8*a* disposed in the housing 1, a stationary roller 8*b* and a movable roller 8*c* provided within the hollow seat 8*a*, and a retaining rod 8*d* for retaining the movable roller 8*c* to prevent removal thereof from the hollow seat 8*a*. The pull ropes 6 pass between the stationary roller 8*b* and the movable roller 8*c*. To lower the slats 5, the pull ropes 6 are moved leftward toward the stationary roller 8*b* to permit downward movement of the movable roller 8*c* away from the stationary roller 8*b* so that the pull ropes 6 are not clamped between the stationary roller 8*b* and the movable roller 8*c*. The slats 5 can thus be lowered due to the weight of the bottom rail 7. When the slats 5 are lowered to a desired position and are to be positioned thereat, the pull ropes 6 are moved rightward (as illustrated by the phantom lines of FIG. 2) to move the movable roller 8*c* upward toward the stationary roller 8*b* for retaining the movable roller 8*c* between the stationary roller 8*b* and an inner surface of the hollow seat 8*a*, thereby clamping the pull ropes 6 between the stationary roller 8*b* and the movable roller 8*c*. To raise the slats 5, the pull ropes 6 are pulled downwardly. At this time, the movable roller 8*c* is permitted to move downwardly away from the stationary roller 8*b*. When the slats 5 are raised to a desired position and are to be positioned thereat, the pull ropes 6 are moved rightward to move the movable roller 8*c* upwardly for clamping the pull ropes 6 between the stationary roller 8*b* and the movable roller 8*c*. Since the pull ropes 6 are kept in rolling contact with the periphery of the stationary roller 8*b* during operation thereof, the pull ropes 6 can be operated in a relatively smooth manner. However, during operation of the pull ropes 6 for raising and lowering the slats 5, a relatively large amount of space around the Venetian blind is required for rightward and leftward movement of the pull ropes 6. Moreover, in the aforementioned conventional Venetian blind, the tilt control unit 9 for controlling tilting of the slats 5 is separate from the clamping unit 8 for controlling raising and lowering of the slats 5. The conventional Venetian blind is thus inconvenient to operate and has a disorderly appearance.

Referring to FIG. 3, a conventional operating device which combines the functions of controlling raising and lowering of the slats and adjusting tilting angle of the slats in a single structure is shown to comprise an elongated operating rod which includes a tubular connector 11*a* that is exposed from a top housing of a Venetian blind to which the operating device is applied, and that is coupled to a tilt control unit 11 for adjusting tilting of the slats (not shown) of the Venetian blind. The operating rod further includes an elongated sleeve 12 which has an upper end connected pivotally to a lower end of the tubular connector 11*a* such that axial rotation of the elongated sleeve 12 results in corresponding axial rotation of the shaft of the Venetian blind by means of the tilt control unit 11 so as to tilt the slats of the Venetian blind. Pull ropes 13 of the Venetian blind pass through the tubular connector 11*a* and the elongated sleeve 12. A retaining unit 14 is provided at a lower end of the elongated sleeve 12 and includes a positioning tube 14*a*, a biasing spring 14*b*, a retaining member 14*c*, an outer sleeve 14*d* and a retaining piece 14*e*. The pull ropes 13 extend out of the elongated sleeve 12 and pass through the positioning tube 14*a*. The biasing spring 14*b* biases the outer sleeve 14*d* upwardly so that the pull ropes 13 are clamped tightly between the retaining member 14*c* and the positioning tube 14*a*. The outer sleeve 14*d* is movable downwardly relative to the elongated sleeve 12 to compress the biasing spring 14*b* so as to release the pull ropes 13 and permit raising and lowering of the slats.

The aforementioned operating device offers the advantage of combining the functions of controlling raising and lowering of the slats and adjusting the tilting angle of the slats in a single structure. However, the clamping effect provided by the operating device for clamping the pull ropes is unsatisfactory. It is desirable to incorporate a clamping unit of the type shown in FIG. 2 in an elongated operating rod to achieve a better pull rope-clamping effect, while maintaining the advantage of combining the two different functions in a single structure.

U.S. patent application Ser. No. 08/844,406 by the Applicant discloses an operating device for a Venetian blind. The operating device includes a rotary tilt control unit adapted to be coupled to the shaft of the Venetian, a positioning tube connected to the tilt control unit and adapted to permit extension of the pull ropes of the Venetian blind therethrough, a retaining member axially movable in the positioning tube and having a tapered upper end portion, a biasing spring disposed in the positioning tube for biasing the retaining member upwardly so that the pull ropes can be clamped between the tapered end portion of the retaining member and a top wall of the positioning tube, and an elongated sleeve disposed around the positioning tube and associated operably with the retaining unit so that the pull ropes are released from the retaining unit when the elongated sleeve is moved downwardly. Improvement is desired in the aforementioned operating device to provide a better clamping effect for clamping releasably the pull ropes.

SUMMARY OF THE INVENTION

The main object of the present invention is to provide an operating device which combines the functions of controlling raising and lowering of the slats and adjusting tilting angle of the slats in a single structure and which is capable of clamping releasably and effectively the pull ropes.

Accordingly, the operating device of the present invention is used for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a plurality of pull ropes, each of the pull ropes having a first end which passes through the housing and through the slats and which is mounted to the bottom rail, and a second end which extends out of the housing, a plurality of pairs of tilting cords disposed on opposite longitudinal sides of the slats and having upper ends secured to the shaft and lower ends mounted on the bottom rail, and a plurality of suspending strings disposed below each of the slats and interconnecting the tilting cords. The operating device includes a hollow positioning tube, a stationary roller, a releasable clamping unit, and an elongated sleeve. The positioning tube is adapted to be coupled to the shaft of the Venetian blind such that axial rotation of the positioning tube results in corresponding axial rotation of the shaft to tilt the slats. The positioning tube confines a receiving space that is adapted to permit extension of the second ends of the pull ropes thereinto. The stationary roller is disposed in the receiving space and is mounted rotatably to the positioning tube. The releasable clamping unit is provided in the receiving space and includes a movable roller suspended in the receiving space at one side of the stationary roller such that the stationary roller and the movable roller are adapted to permit extension of the pull ropes therebetween. The releasable clamping unit further includes a biasing spring for biasing the movable roller toward the stationary roller so that the movable roller cooperates with the stationary roller in order to be adapted to clamp the pull ropes therebetween. The elongated sleeve is mounted coaxially on and is slidable axially relative to the positioning tube. The elongated sleeve is associated operably with the releasable clamping unit so that the movable roller is moved away from the stationary roller for releasing the pull ropes when the elongated sleeve is moved downwardly relative to the positioning tube.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
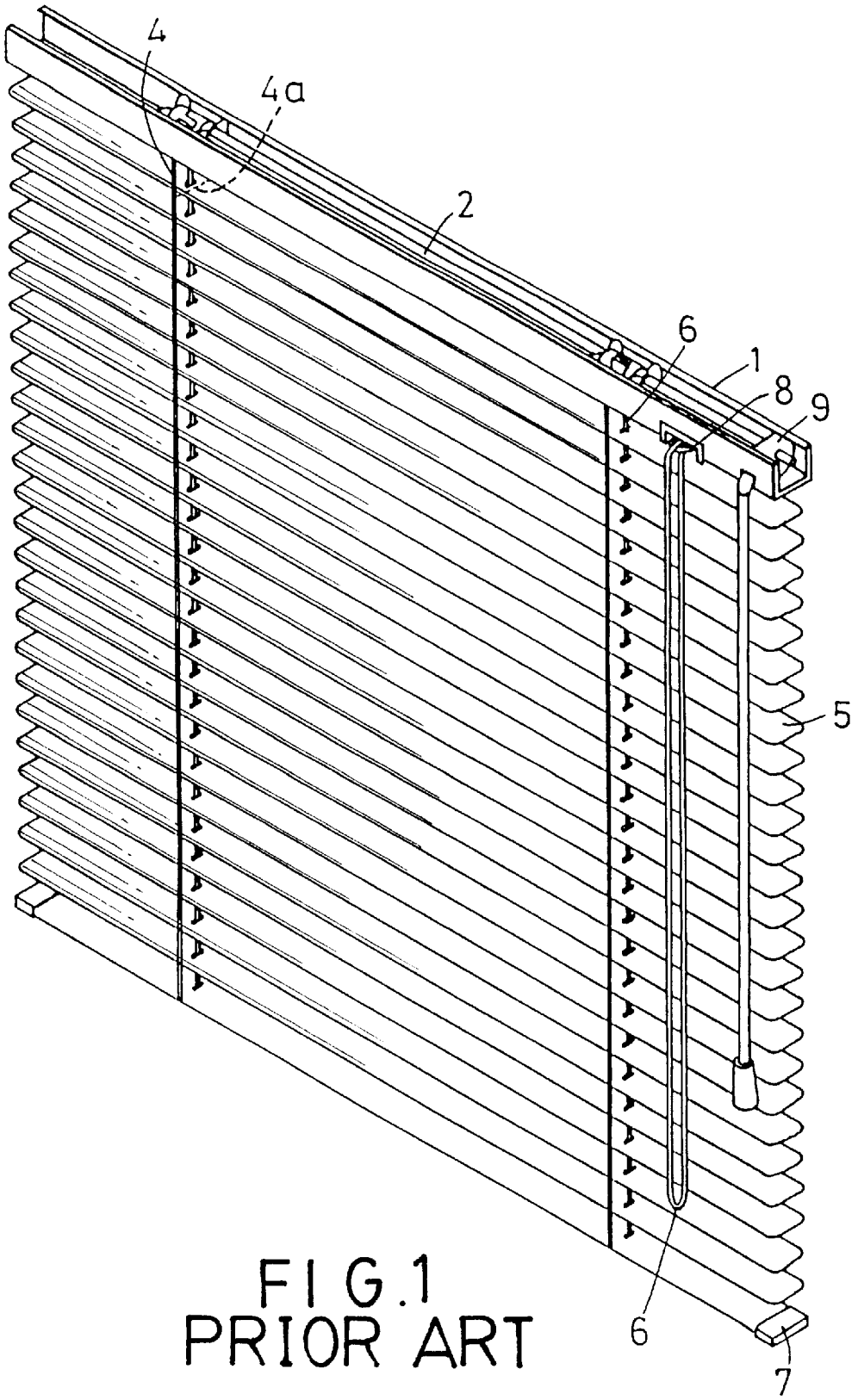
FIG.1 PRIOR ART
FIG. 1 is a perspective view illustrating a conventional Venetian blind.
Figure 2:
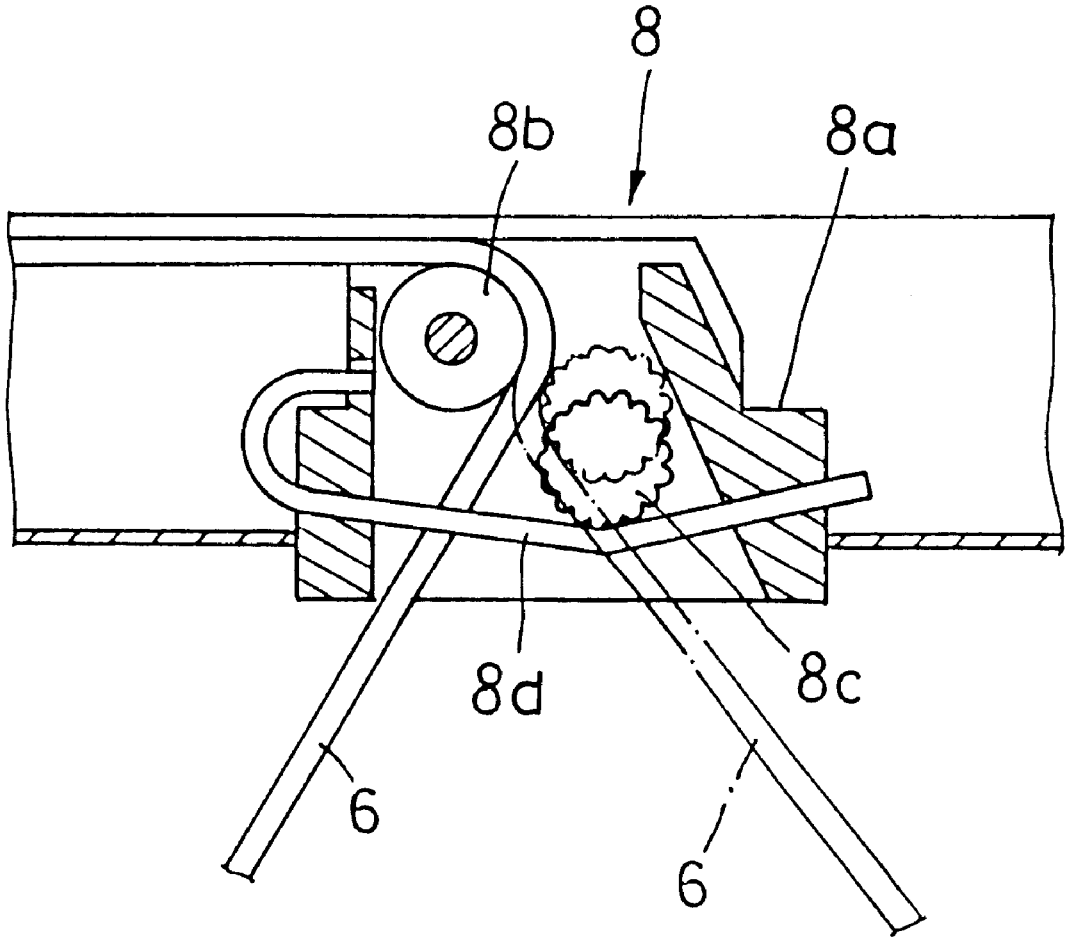
FIG.2 PRIOR ART
FIG. 2 illustrates a clamping unit in the conventional Venetian blind of FIG. 1 for clamping pull ropes of the same.
Figure 3:
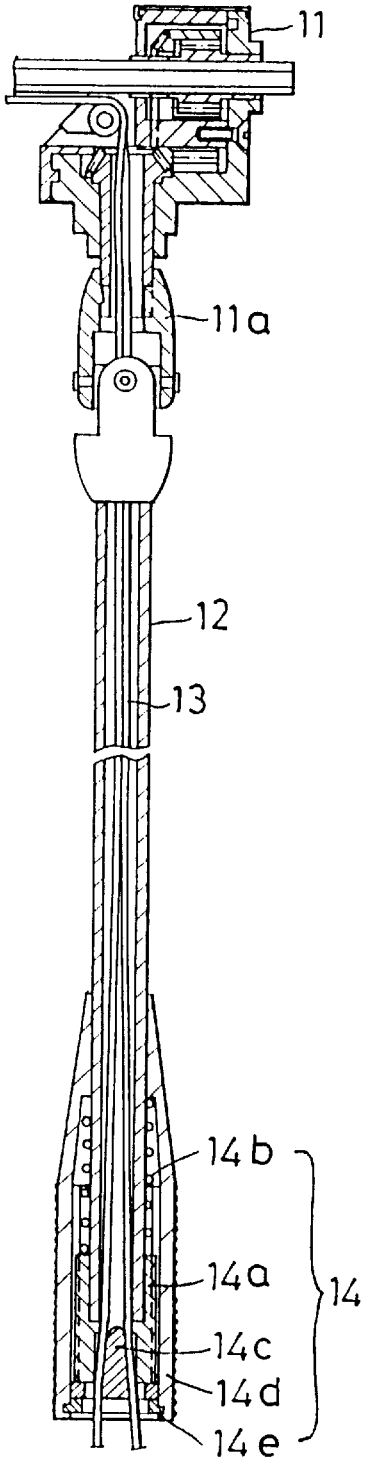
FIG.3 PRIOR ART
FIG. 3 is a vertical sectional view illustrating a conventional operating device for controlling raising and lowering of the slats of a Venetian blind and for adjusting tilting angle of the slats.
Figure 4:
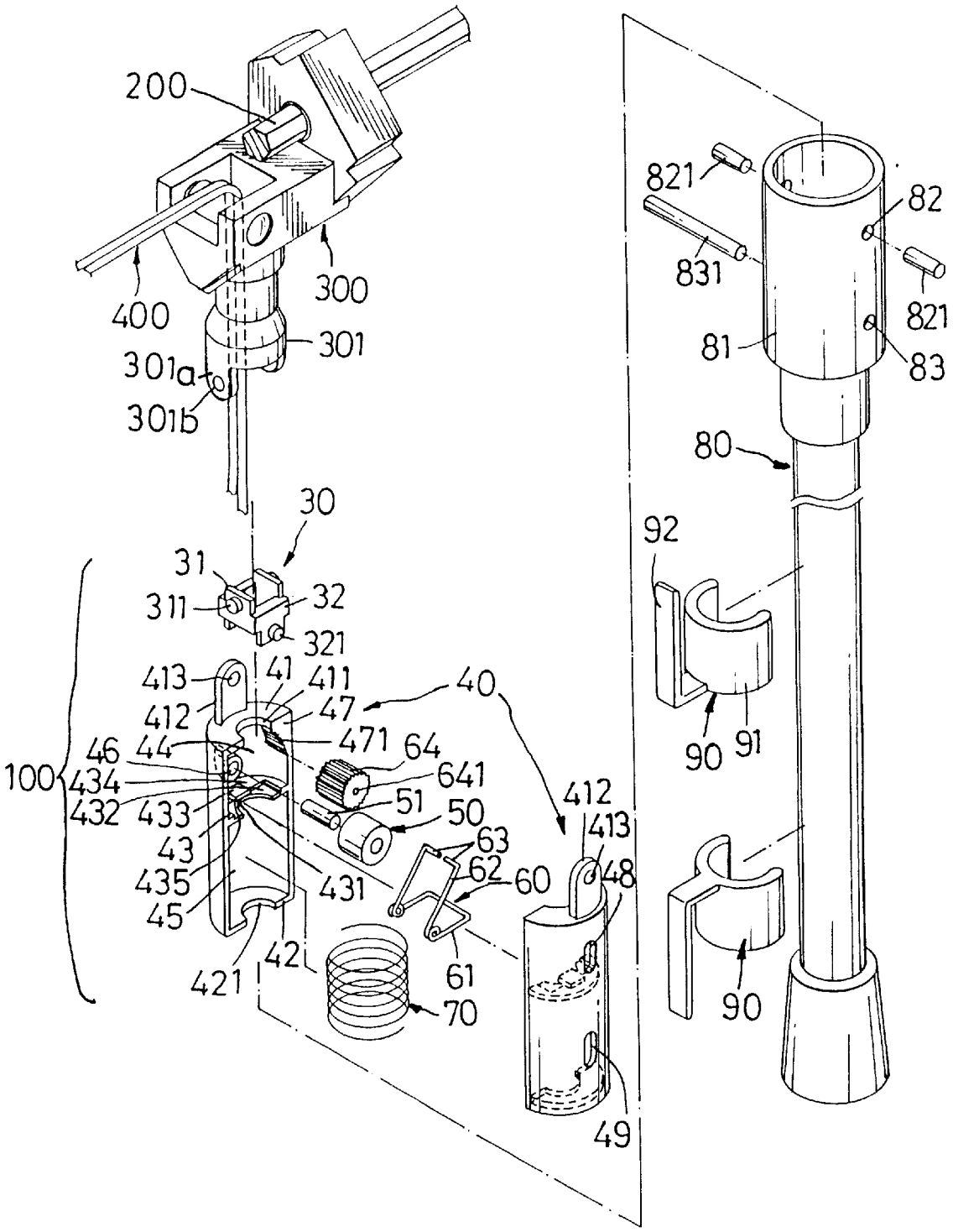
FIG. 4 is an exploded perspective view illustrating an operating device according to a preferred embodiment of the present invention.
Figure 5:
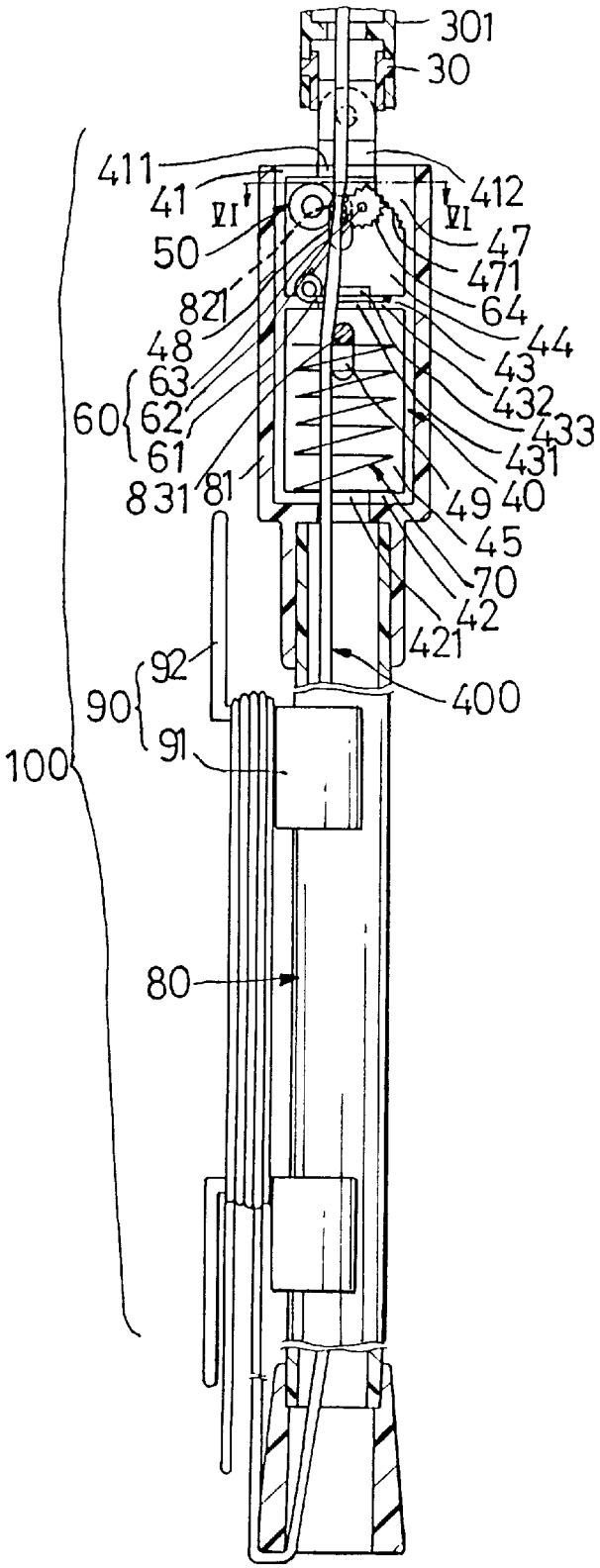
FIG. 5 is a vertical sectional view illustrating the operating device of the preferred embodiment.
Figure 6:
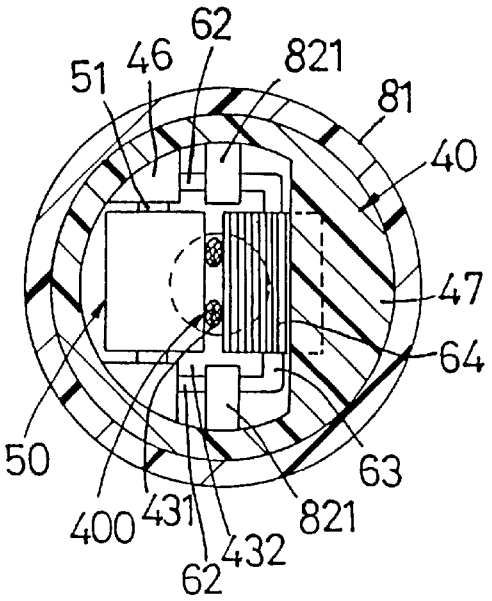
FIG. 6 is a cross-sectional view of the operating device of the preferred embodiment taken along line VI—VI in FIG. 5.

Referring to FIGS. 4, 5 and 6, the preferred embodiment of an operating device according to the present invention is adapted for use with a conventional Venetian blind, such as that shown in FIG. 1, which includes an elongated top housing, a horizontally disposed shaft 200 journalled in the top housing, a tilt control unit 300 coupled to the shaft 200, a plurality of horizontal slats suspended one above another from the top housing, a bottom rail disposed below the slats, a plurality of pull ropes 400, each of which has a first end that passes through the top housing and through the slats and that is mounted to the bottom rail, and a second end that extends out of the top housing, a plurality of pairs of tilting cords disposed on opposite longitudinal sides of the slats and having upper ends secured to the shaft 200 and lower ends mounted on the bottom rail, and a plurality of suspending strings disposed below each of the slats for interconnecting the tilting cords. The tilt control unit 300 has a tubular connector 301 which extends out of the top housing and which permits passage of the second ends of the pull ropes 400 therethrough. The tubular connector 301 has a lower end formed with an opposite pair of downwardly extending first pivot lobes 301*a*, each of which has a first pivot hole 301*b* formed therethrough. The operating device 100 of the preferred embodiment includes a hollow positioning tube 40, a stationary roller 50, a releasable clamping unit, a compression spring 70, an elongated sleeve 80 and two retaining rings 90.

The positioning tube 40 has an upper end formed with an opposite pair of upwardly extending second pivot lobes 412, each of which has a second pivot hole 413 formed therethrough. The positioning tube 40 is connected to the tubular connector 301 of the tilt control unit 300 by means of an annular connector 30 which has an opposite pair of first side walls 31 formed with first radial projections 311 that extend through the first pivot holes 301*b* in the tubular connector 301 for pivotal connection with the tubular connector 301 about a first axis, and an opposite pair of second side walls 32 formed with second radial projections 321 that extend through the second pivot holes 413 in the positioning tube 40 for pivotal connection with the positioning tube 40 about a second axis perpendicular to the first axis. In this manner, a universal pivot joint is formed between the positioning tube 40 and the tubular connector 301. Axial rotation of the positioning tube 40 will result in corresponding axial rotation of the tubular connector 301 and the shaft 200 of the Venetian blind to tilt the slats.

The positioning tube 40 confines a receiving space and has a top end wall 41, a bottom end wall 42 and a transverse base wall 43 which is formed within the receiving space between the top and bottom end walls 41, 42 to divide the receiving space into an upper chamber 44 and a lower chamber 45. Each of the top and bottom end walls 41, 42 and the base wall 43 is formed with an opening 411, 421, 431 which is adapted to permit extension of the second end of the pull ropes 400 therethrough. The base wall 43 has a peripheral portion 434 and a central portion 432 that is indented relative to the peripheral portion 434. The base wall 43 further has an opposite pair of retaining plates 433 that extend from the peripheral portion 434 toward the central portion 432 to define a retaining groove 435 with the central portion 432. The positioning tube 40 has a peripheral wall formed with an opposite pair of aligned tubular pivot seats 46 which extend radially inward into the upper chamber 44. The positioning tube 40 further has an inner surface formed with a retaining protrusion 47 which has a curved contact face 471 that is formed with teeth therealong. The peripheral wall of the positioning tube 40 is further formed with a pair of diametrically opposite, axially extending first radial slots 48 which extend radially to the upper chamber 44, and a pair of diametrically opposite, axially extending second radial slots 49 which extend radially to the lower chamber 45.

The stationary roller 50 is sleeved rotatably on a retaining rod 51 which has opposite ends that extend into the pivot seats 46. Thus, the stationary roller 50 is disposed horizontally in the upper chamber 44 and has an outer surface that is adapted to be kept in rolling contact with the pull ropes 400.

The releasable clamping unit includes a movable roller 64 which is suspended in the upper chamber 44 at one side of the stationary roller 50 so that the stationary roller 50 and the movable roller 64 are adapted to permit extension of the pull ropes 400 therebetween. The movable roller 64 has an outer surface formed with axially extending teeth therearound for meshing with the teeth on the curved contact face 471 of the retaining protrusion 47. The releasable clamping unit further includes a biasing spring 60 with a U-shaped horizontal base portion 61 retained in the retaining groove 435 of the base wall 43, and a pair of inclined biasing arms 62 that extend upwardly from the base portion 61. The biasing arms 62 have upper ends formed with legs 63 which extend toward one another and into an axial hole 641 of the movable roller 64 to support rotatably the movable roller 64 and suspend the same in the upper chamber 44. The biasing arms 62 of the biasing spring 60 bias the movable roller 64 to move along the contact face 471 toward the stationary roller 50 such that the movable roller 64 is retained fittingly and removably between the stationary roller 50 and the curved contact face 471 and such that the movable roller 64 cooperates with the stationary roller 50 so as to be adapted to clamp the pull ropes 400 therebetween. When a downward force is applied to the biasing arms 62 to depress the same, the movable roller 64 is moved along the curved contact face 471 away from the stationary roller 50.

The compression spring 70 is disposed in the lower chamber 45 of the positioning tube 40. The compression spring 70 is adapted to permit extension of the second ends of the pull ropes 400 therethrough and has a lower end abutting against the bottom end wall 42 of the positioning tube 40.

The elongated sleeve 80 has an upper section 81 sleeved around the positioning tube 40, and is adapted to permit extension of the second ends of the pull ropes 400 out of a lower end thereof. The upper section 81 of the elongated sleeve 80 is formed with a pair of diametrically opposite first radial holes 82 for receiving a pair of first insert pins 821, and a pair of diametrically opposite second radial holes 83 for receiving a second insert pin 831. The first insert pins 821 extend through the first radial slots 48 of the positioning tube 40, whereas the second insert pin 831 extends through the second radial slots 49 of the positioning tube 40 for mounting the elongated sleeve 80 coaxially on the positioning tube 40 and so that the elongated sleeve 80 is slidable axially relative to the positioning tube 40. The first insert pins 821 extend into the upper chamber 44 to depress the biasing arms 62 of the biasing spring 60 as shown in FIG. 6. The second insert pin 831 extends into the lower chamber 45 to depress the compression spring 70.

Each of the retaining rings 90 includes a ring portion 91 sleeved securely on an outer surface of the elongated sleeve 80 and an L-shaped hook projection 92 extending integrally from the ring portion 91. The retaining rings 90 in the present embodiment include an upper one with the hook projection 92 extending upward and a lower one with the hook projection 92 extending downward. The end portions of the pull ropes 400 that extend out of the elongated sleeve 80 may be wound around both of the hook projections 92 and hooked on one of the hook projections 92.

After the operating device 100 has been installed on a Venetian blind, the pull ropes 400 of the Venetian blind pass through the tubular connector 301, the annular connector 30, the positioning tube 40 and the elongated sleeve 80, and have end portions hooked at the hook projection 92 of one of the retaining ring 90, as shown in FIG. 5. Normally, the biasing arms 62 of the biasing spring 60 bias the movable roller 64 to move along the curved contact face 471 of the retaining protrusion 47 toward the stationary roller 50 and to be retained fittingly between the retaining protrusion 47 and the stationary roller 50 for clamping the pull ropes 400 between the movable roller 64 and the stationary roller 50, thereby positioning the slats. Under this condition, the first and second insert pins 821, 831 are respectively located at upper ends of the first and second radial slots 48, 49.

Figure 7:
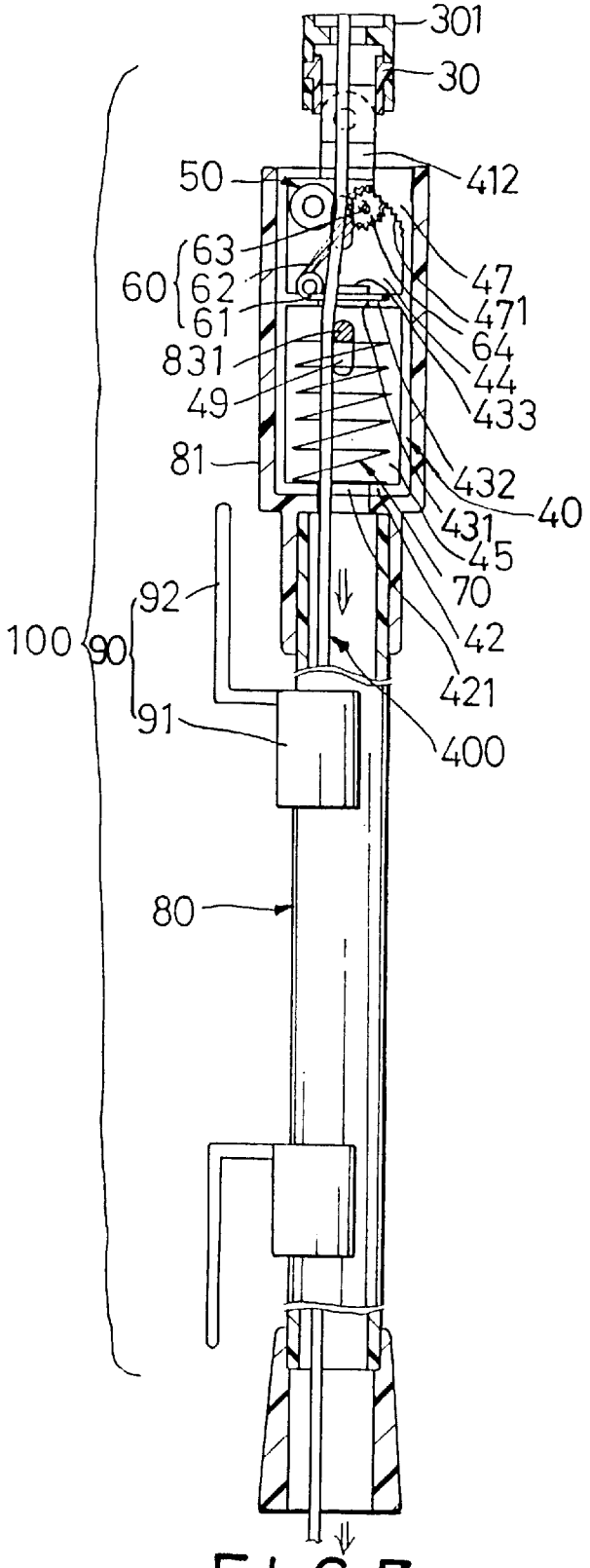
FIG. 7 is a sectional view illustrating how the operating device of the preferred embodiment is operated to raise the slats of the Venetian blind.

Referring to FIG. 7, when the slats are to be raised, the end portions of the pull ropes 400 are released from the hook projection 92 and are pulled downwardly so that the movable roller 64 is actuated by the pull ropes 400 to move along the curved contact face 471 of the retaining protrusion 47 away from the stationary roller 50. At this time, the biasing arms 62 of the biasing spring 60 are slightly depressed. After the slats are adjusted to a desired position, the pulling force applied to the end portions of the pull ropes 400 is released so that the movable roller 64 returns to its biased position to clamp the pull ropes 400 against the stationary roller 50 so as to position the slats.

Figure 8:
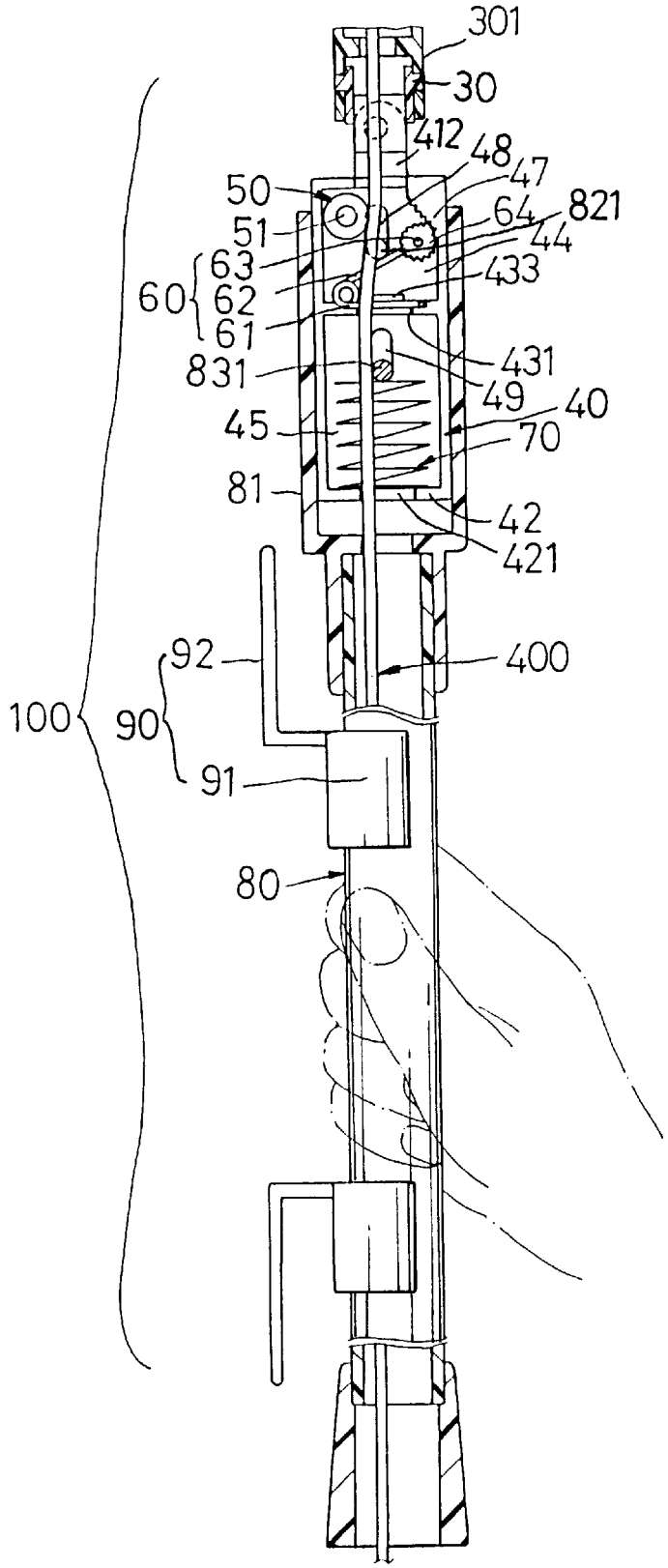
FIG. 8 illustrates how the operating device of the preferred embodiment is operated to lower the slats of the Venetian blind.

Referring to FIG. 8, when the slats are to be lowered, a downward force is applied to the elongated sleeve 80 so that the first and second insert pins 821, 831 are moved downwardly together with the elongated sleeve 80 to compress the biasing spring 60 and the compression spring 70, respectively. Since the biasing arms 62 are depressed by the first insert pins 821, the movable roller 64 is forced to move along the retaining protrusion 47 away from the stationary roller 50 so as to release the pull ropes 400 and to lower the slats. When the slats are lowered to a desired position and are to be positioned thereat, the downward force applied to the elongated sleeve 80 is released. At this time, the compression spring 70 provides a restoring force to the second insert pin 831 for moving the elongated sleeve 80 and the first insert pins 821 upwardly relative to the positioning tube 40. Thus, the depressing forced applied by the first insert pins 821 to the biasing arms 62 of the biasing spring 60 is released. The movable roller 64 returns to its biased position for clamping the pull ropes 400 against the stationary roller 50.

To adjust the tilting angle of the slats, the elongated sleeve 80 is rotated axially to rotate the positioning tube 40 axially. Since the positioning tube 40 is connected to the tubular connector 301 by virtue of a universal pivot joint, the tubular connector 301 is rotated axially together with the positioning tube 40 to cause axial rotation of the shaft of the Venetian blind to tilt the slats in a known manner.

It should be noted that in this embodiment, the positioning tube 40 is formed with a pair of first radial slots 48 and a pair of second radial slots 49, while the elongated sleeve 80 is formed with a pair of first radial holes 82 and a pair of second radial holes 83. However, the positioning tube 40 may be formed with only one first radial slot 48 and only one second radial slot 49, while the elongated sleeve 80 may be formed with only one first radial hole 82 and only one second radial hole 83. In this case, first and second insert pins 821, 831 are still extendible through the radial holes 82, 83 and the radial slots 48, 49 and into the upper and lower chambers 44, 45, respectively. Depression of at least one of the biasing arms 62 might be sufficient to compress the biasing spring 60. Alternatively, the operating device may be modified to place the stationary roller 50 and the releasable clamping unit in the lower chamber 45 of the receiving space, and to place the compression spring 70 in the upper chamber 44.

With the use of the operating device of the present invention, the pull ropes of the Venetian blind can be clamped more effectively and releasably between a stationary roller and a movable roller while maintaining smooth operation of the same. In the illustrated embodiment, retaining rings with hook projections are provided for winding and hooking end portions of the pull ropes thereat to prevent strangling of children thereby.

With this invention thus explained, it is apparent that numerous modifications and variations can be made without departing from the scope and spirit of this invention. It is therefore intended that this invention be limited only as indicated in the appended claims.

I claim:

1. An operating device for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a plurality of pull ropes, each of the pull ropes having a first end which passes through the housing and through the slats and which is mounted to the bottom rail, and a second end which extends out of the housing, a plurality of pairs of tilting cords disposed on the opposite longitudinal sides of the slats and having upper ends secured to the shaft and lower ends mounted on the bottom rail, and a plurality of suspending strings disposed below each of the slats and interconnecting the tilting cords, said operating device comprising:

a hollow positioning tube adapted to be coupled to the shaft of the Venetian blind such that axial rotation of said positioning tube results in corresponding axial rotation of the shaft to tilt the slats, said positioning tube confining a receiving space that is adapted to permit extension of the second ends of the pull ropes thereinto;

a stationary roller disposed in said receiving space and mounted rotatably to said positioning tube;

a releasable clamping unit provided in said receiving space, said releasable clamping unit including a movable roller suspended in said receiving space at one side of said stationary roller such that said stationary roller and said movable roller are adapted to permit extension of the pull ropes therebetween, a biasing spring for biasing said movable roller toward said stationary roller that said movable roller cooperates with said stationary roller in order to be adapted to clamp the pull ropes therebetween, said biasing spring including a horizontal base portion and a pair of inclined biasing arms which extend upwardly from said base portion and which have upper ends that support rotatably said movable roller for suspending said movable roller in said receiving space of said positioning tube, said positioning tube being formed with retaining means for retaining said base portion of said biasing spring therein, said positioning tube having a peripheral wall with an axially extending first radial slot formed therethrough; and an elongated sleeve mounted coaxially on and slidable axially relative to said positioning tube, said elongated sleeve being associated operably with said releasable clamping unit so that said movable roller is moved away from said stationary roller for releasing the pull ropes when said elongated sleeve is moved downwardly relative to said positioning tube, said elongated sleeve being provided with a first insert pin which extends through said first radial slot and into said receiving space and which depresses at least one of said biasing arms of said biasing spring, said first insert pin compressing said biasing spring so as to move said movable roller away from said stationary roller for releasing the pull ropes when said elongated sleeve is moved downwardly relative to said positioning tube.

2. The operating device according to claim 1, wherein said positioning tube has a transverse base wall formed within said receiving space, said base wall having a peripheral portion and a central portion that is indented relative to said peripheral portion, said base wall further having an opposite pair of retaining plates that extend from said peripheral portion toward said central portion to define a retaining groove with said central portion and that serve as said retaining means for retaining said base portion of said biasing spring.

3. The operating device according to claim 1, wherein said positioning tube has an inner surface formed with a retaining protrusion which has a curved contact face, said biasing spring biasing said movable roller to move along said curved contact face such that said movable roller is retained fittingly and removably between said stationary roller and said curved contact face.

4. The operating device according to claim 3, wherein said movable roller is formed with axially extending teeth therearound, said curved contact face of said retaining protrusion being formed with teeth therealong for meshing with said teeth of said movable roller.

5. The operating device according to claim 1, further comprising a compression spring disposed in said positioning tube, said peripheral wall of said positioning tube further having an axially extending second radial slot formed therethrough, said elongated sleeve being provided with a second insert pin which extends through said second radial slot and into said receiving space and which depresses said compression spring, thereby permitting compression of said compression spring when said elongated sleeve is moved downwardly relative to said positioning tube to generate a restoring force for moving said elongated sleeve upwardly relative to said positioning tube when said elongated sleeve is released.

* * * * *